US006123283A

United States Patent [19]

Hayashi et al.

[11] Patent Number: 6,123,283

[45] Date of Patent: Sep. 26, 2000

[54] AUTOMATIC WINDING MACHINE

[75] Inventors: Shigeru Hayashi; Toshio Matsubara, both of Kyoto, Japan

[73] Assignee: Murata Kikai Kabushiki Kaisha, Kyoto, Japan

[21] Appl. No.: 09/177,107

[22] Filed: Oct. 22, 1998

[30] Foreign Application Priority Data

Dec. 25, 1997 [JP] Japan ..... 9-357957

[51] Int. Cl.[7] ..... B65H 54/02; B65H 59/10

[52] U.S. Cl. ..... 242/419.4; 242/475.6; 242/485.2; 242/487.3

[58] Field of Search ..... 242/419.4, 419.3, 242/419, 475.1, 475.2, 475.4, 475.5, 475.6, 485.2, 485.5, 486.3, 487.3

[56] References Cited

U.S. PATENT DOCUMENTS

| | | | |
|---|---|---|---|
| 4,805,846 | 2/1989 | Ueda et al. | 242/487.3 |
| 4,880,175 | 11/1989 | Yamauchi et al. | 242/475.5 |
| 5,605,296 | 2/1997 | Haasen et al. | 242/475.6 |
| 5,676,329 | 10/1997 | Bertoli et al. | 242/486.3 |
| 5,862,660 | 1/1999 | Haasen et al. | 242/475.6 |
| 5,871,163 | 2/1999 | Bertoli et al. | 242/419.3 |

FOREIGN PATENT DOCUMENTS

| | | |
|---|---|---|
| 2-40579 | 9/1990 | Japan . |
| 7-29727 | 4/1995 | Japan . |

*Primary Examiner*—John M. Jillions
*Attorney, Agent, or Firm*—Armstrong, Westerman, Hattori, McLeland and Naughton

[57] ABSTRACT

To provide an automatic winding machine wherein even if a yarn splicing operation is carried out during the reduction of yarn winding tension at the time of winding yarn splicing, the subsequent winding tension can be maintained at an appropriate value depending upon the amount of remaining yarn. In an automatic winding machine including a tension apparatus 2 that can adjust yarn winding tension by reducing it at a predetermined rate at the time of yarn splicing, a rapid tension reduction pattern used after a yarn splicing operation during tension reduction at the time of yarn splicing is different from a rapid tension reduction pattern used after the yarn splicing operation during normal winding.

4 Claims, 3 Drawing Sheets

AUTOMATIC WINDING MACHINE

FIELD OF THE INVENTION

The present invention relates to a method for operating an automatic winding machine wherein an adjustment value for a tension apparatus for adjusting winding tension is set higher than a reference value upon activation of the rotation of a driving drum and is reduced as the amount of remaining yarn on a yarn supply bobbin decreases, and wherein the automatic winding machine executes rapid winding at a constant winding tension from the beginning of yarn on the winding of the yarn supply bobbin to its end.

BACKGROUND OF THE INVENTION

The spun bobbins produced by a spinning machine are supplied to an automatic winding machine in a subsequent step in which a yarn is wound onto a package of a predetermined shape that can hold a predetermined amount of yarn thereon, while removing defects from the yarn.

In the concerned automatic winding machine, the yarn unwound from the spun bobbin passes through a balloon controller and a tension apparatus and is checked by a slab catcher for defects while being wound around a package rotating on a traverse drum. During winding, the yarn is cut when the slab catcher detects the yarn defect and, after removal of the defective portion of the yarn, the yarn on the package side and the yarn on the spun bobbin side are spliced together.

The tension approaches is controlled so that during the unwinding of the spun bobbin, the tension of the yarn winding is controlled so as to become slightly higher than a reference value as winding begins, then to decrease down to the reference value, and to decrease at a predetermined rate relative to the reference value from the start of a decrease in the amount of remaining yarn until winding is complete.

When the slab catcher detects the yarn defect near the winding end of the spun bobbin and winding is restarted after a yarn splicing operation, the yarn winding tension is returned to the value used at the start of winding and is gradually reduced relative to the reference value. In such a case, however, the value does not decrease down to the yarn winding tension used at the winding end, such that the winding tension is increased at the winding end to disturb the shapes of the packages.

It is thus an object of the present invention to solve this problem and to provide a method for operating an automatic winding machine wherein, even if the yarn splicing is executed while the yarn winding tension is decreasing toward the winding end, the subsequent winding tension can be maintained at an appropriate value depending on the amount of the remaining yarn.

SUMMARY OF THE INVENTION

To achieve this object, the present invention provides a method for operating the above automatic winding machine wherein the adjustment value return pattern used after the yarn splicing operation while the adjustment value for the tension apparatus is being reduced is different from the return pattern used prior to the decrease in the amount of remaining yarn on said yarn supply bobbin. An adjustment value used immediately before the yarn splicing operation during a decrease in the amount of remaining yarn on the yarn supplies bobbin may be stored to return this value to the stored value after the yarn splicing operation is complete. After the yarn splicing operation, the value may be returned to the stored adjustment value, or to a second adjustment value, based on the stored adjustment value and may then be gradually reduced. A set value is provided for the period during which the yarn on the bobbin decreases, and different adjustment value return patterns may be used for cases in which yarn splicing is executed before the adjustment value reaches the set value, or in which yarn splicing is executed after the adjustment value has reached the set value.

DETAILED DESCRIPTION OF THE PREFERRED EMBODIMENT

One preferred embodiment of the present invention is described in detail with reference to the attached drawings.

Figure 5:
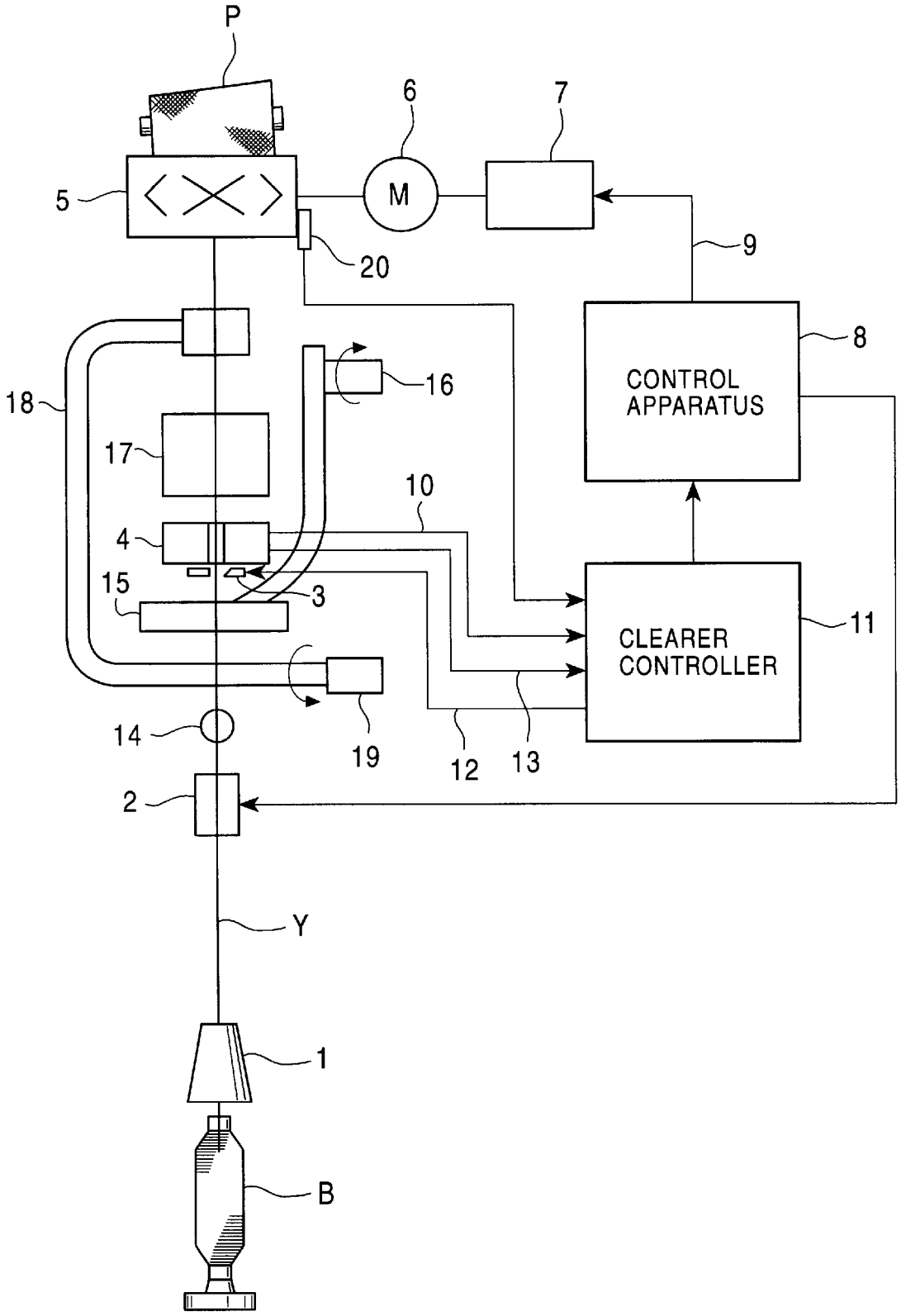
FIG. 5 shows a schematic representation of an automatic winding machine according to the present invention.

First, the basic configuration of an automatic winding machine according to the present invention is described with reference to FIG. 5.

A Yarn Y unwound and drawn from a spun bobbin B passes through a balloon controller 1 and a tension apparatus 2 and is checked for defects by a slab catcher 4 with a cutter 3 while being wound around a package P rotated by a traverse drum 5.

The traverse drum 5 is rotated by a drum driving motor 6 that is driven by an inverter 7 having a variable output frequency. Based on an instructed frequency value 9 from a control apparatus 8, the inverter 7 drives the drum driving motor 6 at the instructed rotation speed.

During winding, any variation in the thickness of the yarn passing through the slab catcher 4 is input to a clearer controller 11 as an electric signal 10, and the clearer controller 11 compares the variation with a reference value to determine that a defective portion has passed, if the result of the comparison exceeds a set tolerance. Then, the clearer controller 11 immediately outputs a driving instruction signal to the cutter 3 of the slab catcher 4, which then operates a compulsorily cut the yarn.

In response to the cutting of the yarn, a yarn forward (FW) signal 13 from the slab catcher 4 is turned off to allow the yarn cut to be detected, and the clearer controller 11 issues a stop instruction to the drum driving motor 6 via the control apparatus 8 to stop the rotation of the drum 5.

Subsequently, an operation to splice the yarns on the spun bobbin B side and the yarn on the package P side together, is performed.

First, when the cutter 3 of the slab catcher 4 cuts the yarn Y, the yarn on the package P side (upper yarn) is wound around the package P, while the yarn on the spun bobbin B side (lower yarn) is trapped by a yarn trap 14.

During this yarn splicing operation, for the upper yarn, a suction mouth 15 rotationally moves upward around a shaft 16, as shown by the arrow, so as to be located close and opposite to the circumferential surface of the package P, and the traverse drum 5 is positioned to capture the end of the upper yarn located on the circumferential surface of the package P. The suction mouth 15 is subsequently rotationally moved downward to guide the upper yarn to a yarn splicing apparatus 17. For the lower yarn, a relay pipe 18 rotationally moves downward around a shaft 19 to capture the lower yarn trapped by the yarn trap 14, and is then rotationally moved upward to guide the lower yarn to the yarn splicing apparatus 17. After the upper and lower yarns have been guided to the yarn splicing apparatus 17, they are spliced together and the traverse drum 5 is rotated to start winding again.

In addition, during winding, the rotation of the traverse drum 5 is detected by a rotation sensor 20 and the detected value is input to the control apparatus 8 via the clearer controller 11, and based on the rotation speed of the traverse drum 5, the control apparatus 8 calculates the length of the yarn wound around the package P to cause specified-length winding of the package P to be effected.

Furthermore, the control apparatus 8 calculates the amount of yarn remaining on the bobbin B from its initial winding until its end during the unwinding of yarn from the spun bobbin B, to output a value for the yarn winding tension to the tension apparatus 2 from the start of winding to its end. In this case, the balloon controller 1 is controlled to gradually lower from initial winding of the spun bobbin B until the end of the winding as a result of the unwinding of yarn from the spun bobbin B, in order to maintain the diameter of a balloon at a constant value during unwinding.

Figure 1:
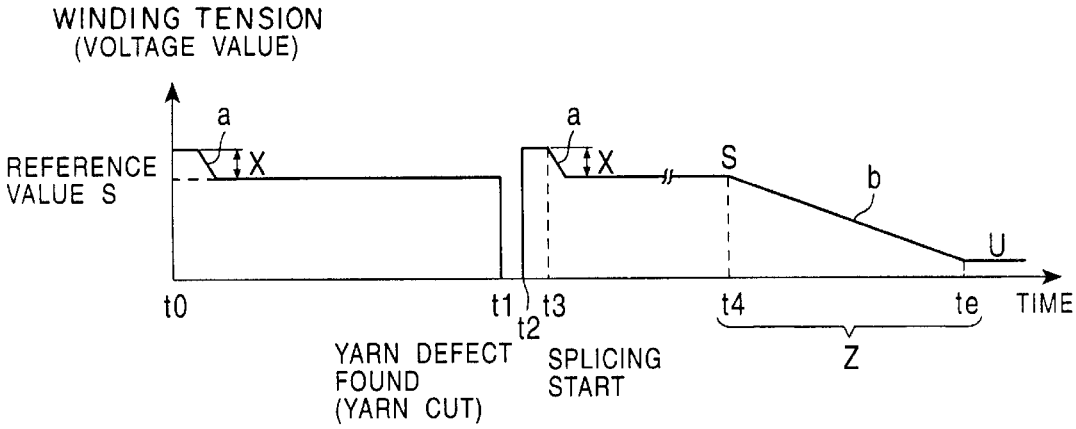
FIG. 1 describes the adjustment of yarn winding tension according to the present invention.

FIG. 1 shows the variation in the control of yarn tension carried out by the tension apparatus 2 over time, from initial winding of the spun yarn until its end during the unwinding of the spun bobbin B.

First, from initial winding t0 during unwinding, the yarn winding tension (voltage) is kept higher than a reference value S by X and is reduced down to the reference value S using a first inclination a when the yarn forward (FW) signal is turned on. The reference value S is input and set by an operator and the period of time during which the yarn winding tension is maintained at the reference value S is called "normal winding."

The inclination a is set that the tension reduction period becomes equal to the time required until a predetermined speed (winding speed) is reached from the time the traverse drum 5 (the package P) begins to rotate. The difference (X in FIG. 1 to 3) between the reference value and the maximum value during clamping between plates of the tension device 2, of well known type, is set to be constant despite changes in yarn type, yarn count and reference value S.

When the yarn winding tension is applied at the reference value and a yarn defect is found at a time t1 during winding, the yarn is cut, the value of the yarn winding tension becomes zero, and the upper and lower yarns are guided to the yarn splicing apparatus 17, as described above. Subsequently, at a time t2, the yarn winding tension is set higher than the reference value S by X, as during initial winding. The yarn splicing (commonly by air injection) is started and once the yarn splicing has been completed, winding is started. When it is detected at a time t3 that the signal FW from the slab catcher 4 is turned on, the value is reduced with the inclination a to effect normal winding with the yarn winding tension set at the reference value S.

Subsequently, the amount of remaining yarn on the spun bobbin B decreases, and during a period of time Z between a winding end te and the point of time when the balloon controller 1 shown in FIG. 5 reaches its lowest point, or the point of time t4 when the amount of remaining yarn on the spun bobbin B is determined to reach a predetermined value based on the rotation speed of the traverse drum 5, the yarn winding tension is gradually reduced from the reference value S to the minimum yarn winding tension value U using a second inclination b until the amount of remaining yarn becomes zero at te. In this case, the yarn winding tension is set at the minimum value instead of zero because, if it is set at zero, the yarn flaps on the tension apparatus 2 during yarn travelling resulting in unstable winding tension.

According to the present invention, the value of the yarn winding tension is adjusted so that if the slab catcher 4 detects a yarn defect and executes a yarn splicing signal while the yarn winding tension is being reduced at a predetermined rate (the gentle inclination b) at the winding end (the period Z), the yarn winding tension is set at the minimum value U when the amount of the remaining yarn on the spun bobbin B becomes zero. Specifically, the rapid tension reduction pattern used after the yarn splicing operation during reduction at the winding end (the period Z) is different from the rapid tension reduction pattern used after the yarn splicing operation during normal winding.

This adjustment is described with reference to FIG. 2.

During the reduction of yarn winding tension relative to the reference value S using an inclination b gentler than the first inclination a from the point of time t4 when the amount of the remaining yarn becomes a predetermined value (or the balloon controller 1 reaches the lowest point), a yarn defect is found at a time t5 when the yarn is cut, the value of yarn winding tension becomes zero, and the upper and lower yarns are guided to the yarn splicing apparatus 17. Subsequently, at a time t6, the yarn winding tension (S+X) is set higher than the reference value S by X as in the winding start, and yarn splicing is started and completed, and then, when the signal FW from the slab catcher 4 is turned on at a time t7, the conventional technique reduced the voltage in accordance with the first inclination a, and when the reference value S is reached, reduces it in accordance with the second inclination b, as shown by the alternating long and short dashed line. The conventional technique, however, results in a high value of the yarn winding tension even at the winding end te when the amount of the remaining yarn becomes zero and fails to allow the minimum value U to be reached. Consequently, the winding tension at the winding end increases and cannot be maintained at a constant value, thereby disturbing the shape of the package.

Figure 2:
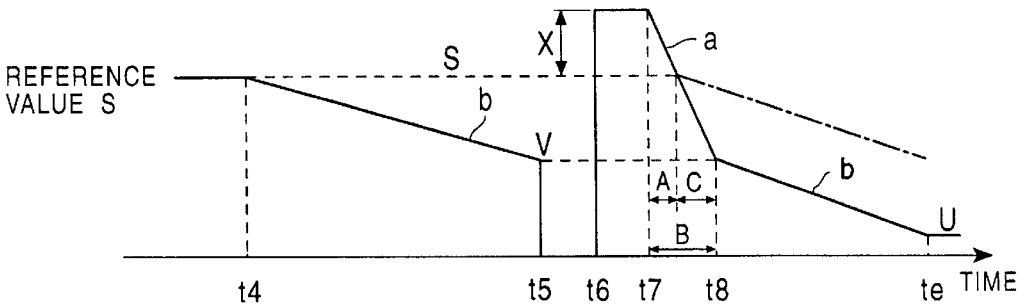
FIG. 2 describes the adjustment of yarn winding tension used after a yarn splicing operation during tension reduction at the time of winding ending according to the present invention.

Thus, as shown in FIG. 2, the present invention stores the value of the yarn winding V at the time t5 when a yarn defect has been found, and when the signal FW is turned on, reduces the pressurizing tension from the maximum value (S+X) obtained during clamping to the stored value V obtained at the time t5 when the yarn defect has been found, using a first inclination a that enables more rapid tension reduction than a second inclination b. The present invention further reduces the yarn winding tension from the value V using the second inclination b to achieve the minimum yarn winding tension value U at the winding end te, thereby enabling winding tension to be maintained at an approximately constant value as in techniques without the yarn splicing, even if the yarn splicing is carried out during the tension reduction with the second inclination b at the winding end.

In FIG. 2, a conventional rapid tension reduction period A after a yarn splicing operation is set equal to the time required to increase the winding speed and the yarn winding tension is reduced to the value V stored with the inclination a, so a tension reduction period B is longer than the time required to increase the winding speed. Thus, even after the increase in the winding speed, the rapid tension reduction continues for a small amount of time (the period C). The yarn winding tension, however, should be inherently gradually reduced during the period C which is very short, so the variation of winding tension is not significantly affected.

This prevents the shape of the package from being disturbed and thus improves its quality.

Figure 3:
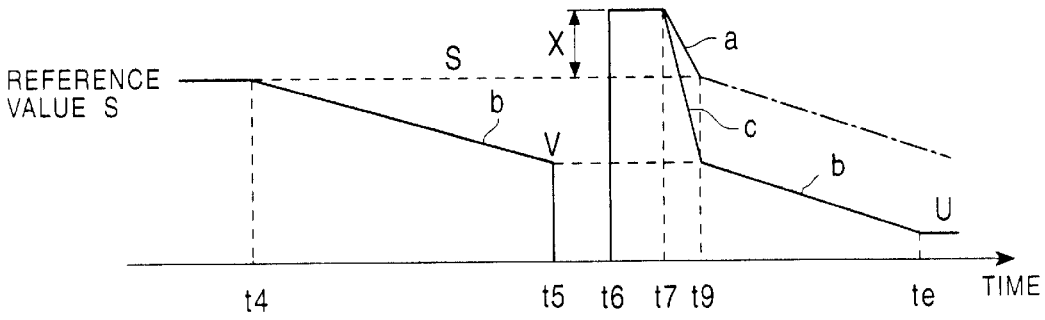
FIG. 3 describes another example of the adjustment of yarn winding tension used after a yarn splicing operation during tension reduction at the winding ending in FIG. 2.

FIG. 3 shows an example of a rapid tension reduction pattern used after the completion of the yarn splicing operation during the period Z.

In FIG. 3, the present invention stores the value of the winding tension V at the time t5 when a yarn defect has been found, and when the signal FW is turned on, reduces the yarn winding tension from the maximum value (S+X) obtained during clamping to the stored value V obtained at the time t5 when the yarn defect was found, using a third inclination c that enables more rapid tension reduction than a second inclination b. Thus, the minimum value of the yarn winding tension U can be achieved at the winding end te, thereby enabling winding tension to be maintained at an approximately constant value as in the techniques without the yarn splicing, even if the yarn splicing is carried out during the tension reduction with the second inclination b at the winding end.

In this case, the tension reduction time can be set equal to the time required to increase the winding speed using the inclination c enabling more rapid tension reduction than the inclinations a and b.

Although the embodiments in FIGS. 2 and 3 have been described in conjunction with the stored value of the yarn winding tension V as a target value for rapid tension reduction with the first inclination a or the third inclination c, the present invention is not limited to the stored value V but may use a value higher or lower than the stored value V by some predetermined amount. That is, yarn winding tension after a yarn splicing operation may be adjusted based on the stored value of the yarn winding.

Figure 4:
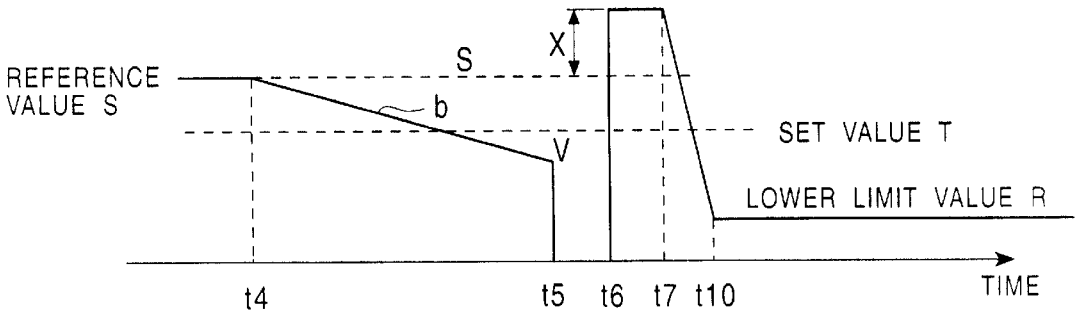
FIG. 4 described yet another example of the adjustment of yarn winding tension used after a yarn splicing operation during tension reduction at the time of winding ending in FIG. 2.

FIG. 4 shows another example of a rapid tension reduction pattern used after the end of the yarn splicing operation during the period Z.

FIG. 4 shows an example in which a value T, smaller than the reference value S, is set for the tension reduction period Z at the winding end, and in which a different rapid tension reduction pattern (a target value) is used after the end of the yarn splicing operation depending on whether the yarn splicing is executed before or after the set value T is reached with the inclination b.

In this case, if the yarn splicing is carried out before the set value T has been reached, the yarn winding tension is reduced down to the tension value stored with the steep inclination a (or the inclination c), as in the examples in FIGS. 2 and 3. If, however, the yarn splicing is carried out after the set value T has been exceeded, the steep inclination a (or the inclination c) may be used to reduce the pressurizing tension down (below the stored tension value) to a preset lower limit R (the lower limit R may be slightly higher than or equal to the minimum value of pressurizing tension U).

Since the unwinding tension of the spun bobbin particularly increases rapidly immediately before the winding end during the tension reduction period Z at the time of the winding end, the tension can be maintained at a more appropriate value until the winding end by setting the value T for the tension reduction at the time of the winding end and using different tension reduction patterns (specifically, changing the target values while maintaining the same inclination) depending on whether the yarn splicing is executed before or after the set value T is reached, as described above.

The tension reduction patterns according to the present invention are not limited to the above embodiments, a range of other variations is possible. An arbitrary tension reduction pattern can be used as long as winding tension is maintained at an approximately constant value from the tension value used immediately before the start of a yarn splicing operation until the minimum value of yarn winding tension U at the time of winding end instead of rapidly reducing yarn winding tension down to the reference value S for normal winding and further reducing it with the second inclination b as in the prior art.

In brief, this invention provides the following effects.

Even if the yarn splicing is carried out during tension reduction at the time of the end of winding the winding tension can be maintained at an approximately constant value until the winding end.

What is claimed is:

1. A method for controlling operation of an automatic yarn winding machine having a tension apparatus, a winding drum drive, a supply bobbin, a splicing device for splicing yarn ends, and a tension controller for controlling the tension apparatus to apply tension to the yarn during a winding operation comprising:

a) setting a yarn tension reference pattern in the controller during a normal winding operation which is reduced during a reduction period when the remaining amount of yarn on the supply bobbin reaches a predetermined amount;

c) setting a tension adjustment value in the controller higher than the reference value which has a particular return pattern to the reference pattern upon activation of rotation of the winding drum drive and after a splicing operation; and d) setting a tension adjustment value in the controller having a different return pattern after a splicing operation during the reduction period.

2. A method for controlling operation of an automatic yarn winding machine having a tension apparatus, a winding drum drive, a supply bobbin, a splicing device for splicing yarn ends, and a tension controller for controlling the tension apparatus to apply tension to the yarn during a winding operation comprising:

a) setting a yarn tension reference pattern in the controller during a normal winding operation which is reduced during a reduction period when the remaining amount of yarn on the supply bobbin reaches a predetermined amount;

b) setting a tension adjustment value in the controller higher than the reference value which returns to the reference pattern upon activation of rotation of the winding drum drive and after a splicing operation;

c) storing the value of the tension apparatus immediately before a splicing operation during the reduction period; and d) returning the tension adjustment value in the controller during the reduction period to a value based upon the stored value after the end of the splicing operation.

3. The method according to claim 2 wherein the value based upon the stored value is the stored value.

4. The method according to any one of claims 1 to 3, including the step of providing a set value of the reference pattern in the controller during the reduction period, determining whether yarn splicing occurs before or after the set value, and using different tension adjustment value return patterns for cases in which the yarn splicing occurs before or after the value of tension of the tension apparatus reaches the set value.

* * * * *